United States Patent [19]

Wu

[11] Patent Number: 4,869,226

[45] Date of Patent: Sep. 26, 1989

[54] ARROW HOLDER FOR A BOW

[76] Inventor: Yu F. Wu, No. 152, Chang Shui Rd., Sec.4, Chi-Hu Chen, Changhwa Hsien, Taiwan

[21] Appl. No.: 231,268

[22] Filed: Aug. 12, 1988

[51] Int. Cl.[4] ..... F41B 5/06

[52] U.S. Cl. ..... 124/24 A; 124/23 A; 124/45; 124/48

[58] Field of Search ..... 124/20 A, 23 A, 24 A, 124/45, 48; 224/916

[56] References Cited

U.S. PATENT DOCUMENTS

| | | | |
|---|---|---|---|
| 2,984,277 | 5/1961 | Neff | 124/23 A |
| 3,017,874 | 1/1962 | Gubash | 124/48 |
| 3,116,730 | 1/1964 | Tingley | 124/24 A |
| 3,397,476 | 8/1968 | Weber | 124/48 |
| 3,601,113 | 8/1971 | Wilkie | 124/48 |
| 4,623,145 | 11/1986 | Paraskevakos | 124/48 |

FOREIGN PATENT DOCUMENTS

| | | | |
|---|---|---|---|
| 1525621 | 9/1978 | United Kingdom | 124/48 |

*Primary Examiner*—Randolph A. Reese

*Assistant Examiner*—Anthony Knight

*Attorney, Agent, or Firm*—Morton J. Rosenberg; David I. Klein

[57] ABSTRACT

This invention relates to an arrow holder for a bow and in particular to one mainly including a sleeve mounted within a retaining ring of the bow with one end facing a bowstring of the bow. A cover is mounted over the front end of the sleeve, and a rotating barrel is disposed within the sleeve with one end thereof extending out of a rear end of the sleeve and being displaced by a predetermined distance from the bowstring. The rotating barrel has a plurality of longitudinally extending slots formed around the outer surface thereof to receive arrows. A sliding ring is mounted on the rotating barrel with an annular groove for receiving a screw extending through the sleeve into the groove, and a positioning ring is mounted on the rotating barrel having a plurality of resilient spring members. A protection ferrule is located over an end of the rotating barrel extending from the rear end of the sleeve for protecting the rotating barrel.

1 Claim, 5 Drawing Sheets

ARROW HOLDER FOR A BOW

BACKGROUND OF THE INVENTION

It is found that the conventional bow mainly comprises a handle 1, an upper limb 11, a lower limb 12, an arrow holder 13 and a bowstring 14 while the arrow 2 has a number of fletchings 21, a nock 22 and a slot 23 (see FIGS. 5, 6, 7, and 8). However, such kind of conventional bow cannot shoot arrows consecutively thus losing many chances to hunt the game.

It is, therefore, an object of the present invention to provide an improved arrow holder for a bow whuch may obviate and mitigate the above-mentioned drawbacks.

SUMMARY OF THE INVENTION

This invention relates to an improved arrow holder for a bow.

It is the primary object of the present invention to provide an arrow holder for a bow which enables the archer to shoot consecutively.

It is another object of the present invention to provide an arrow holder for a bow which is simple in construction.

It is still another object of the present invention to provide an arrow holder for a bow which is easy to manufacture.

It is still another object of the present invention to provide an arrow holder for a bow which is low in fabricating cost.

It is a further object of the present invention to provide an arrow holder for a bow which is effective in use.

The novel features which are characteristices of the invention, together with further objects and advantages thereof will be better understood from the following description considered in connection with the accompanied drawings and in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figures 1, 5, 6:
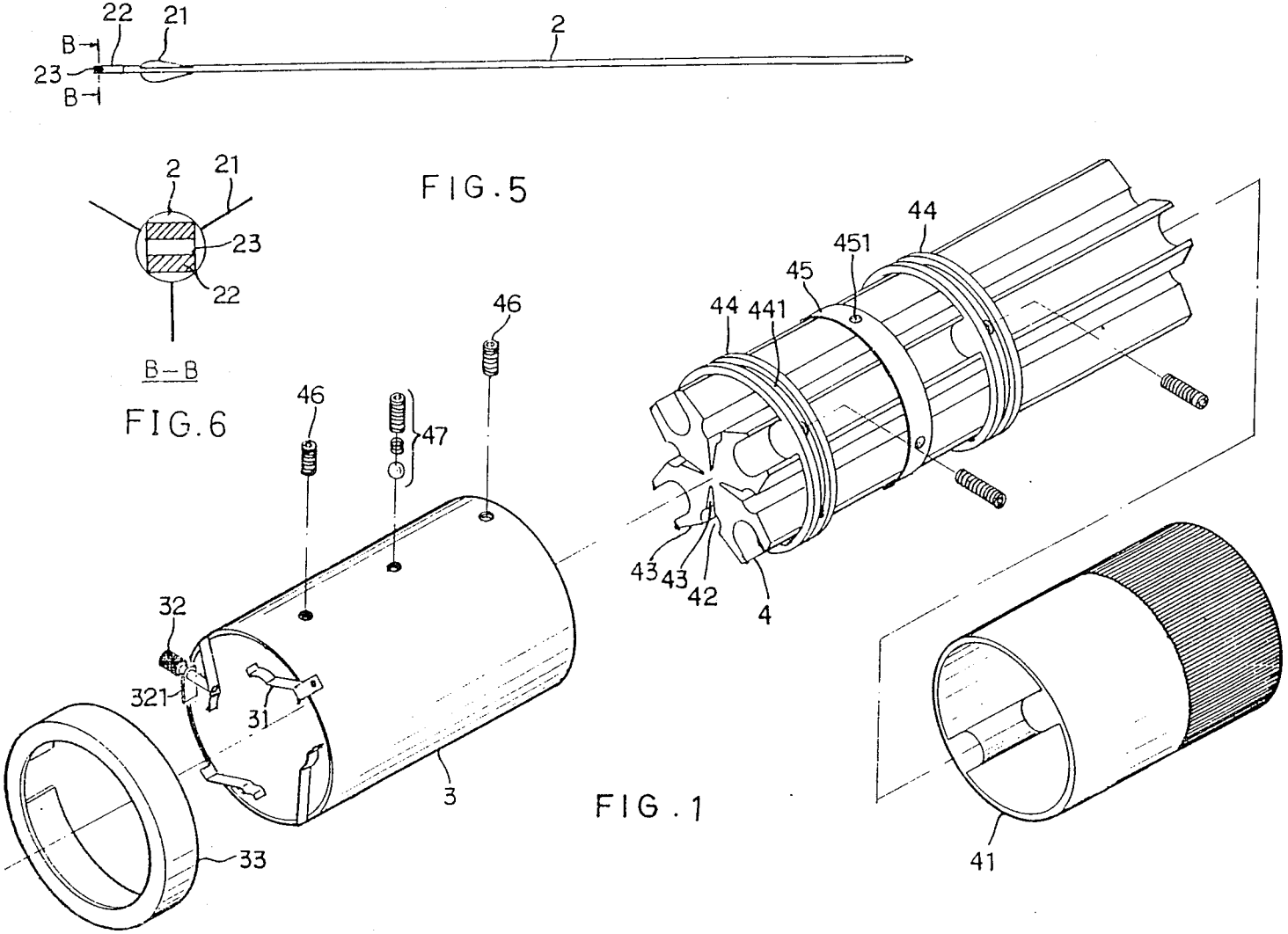
FIG. 1 is an exploded view of an arrow holder for a bow according to a preferred embodiment of the present invention.
FIG. 5 is a side elevational view of an arrow.
FIG. 6 is a sectional view taken along line B—B of FIG. 5.
Figure 2:
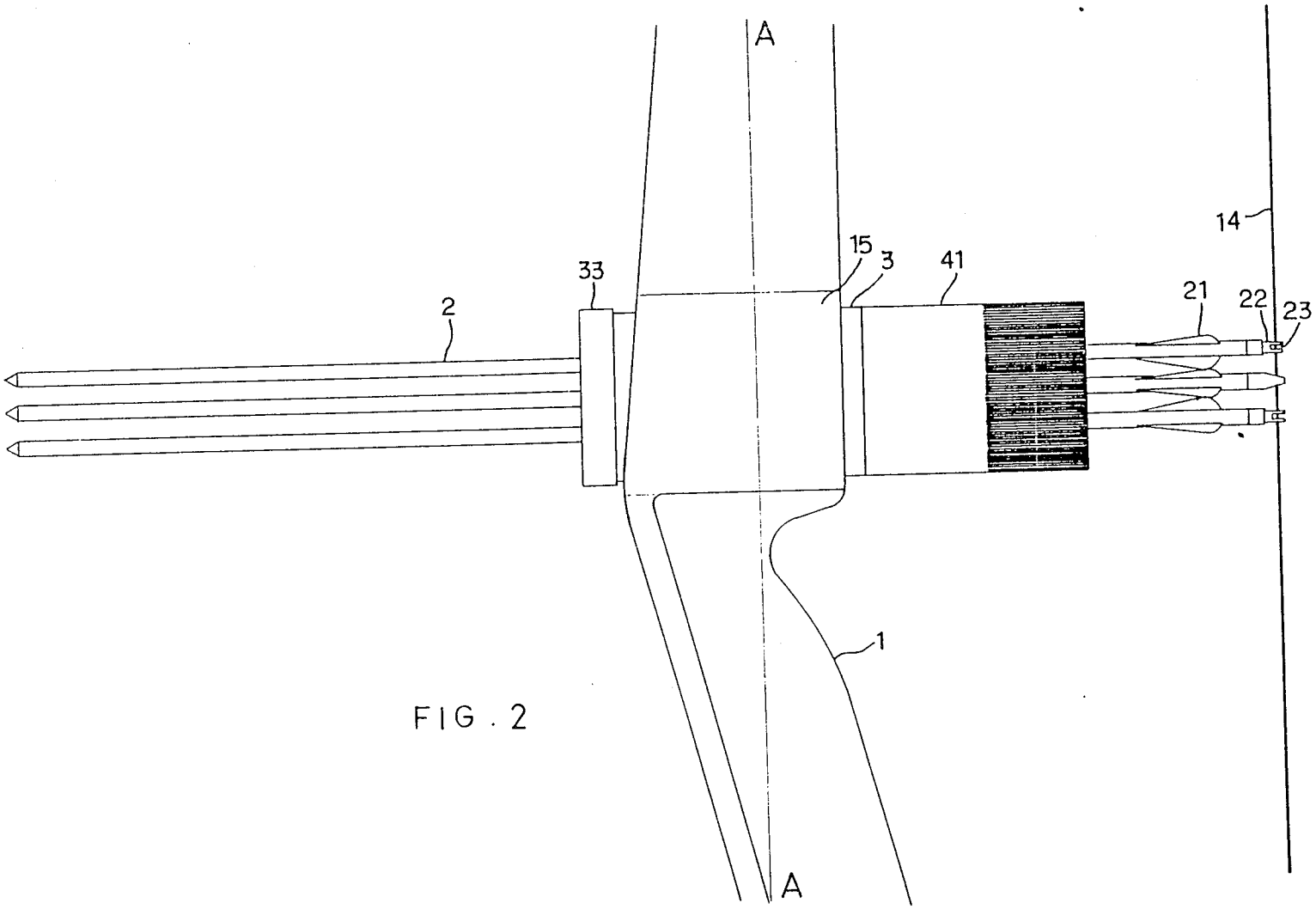
FIG. 2 is a working view of the present invention.

For purposes of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications as would normally occur to one skilled in the art to which the invention relates.

With reference to the drawings and in particular to FIG. 1 thereof, the arrow holder for a bow according to the present invention mainly comprises a sleeve 3 and a rotating barrel 4.

The sleeve 3, which is a cylindrical shell with two open ends, is designed to be mounted within a retaining ring 15 of the bow with its one end facing a bowstring 14 of the bow. On the front end of the sleeve 3 there are a plurality of spring leaves 31 extending inwards. One of the spring leaves 31 is pivotally connected with a lift rod 32. A front cover 33 is used to enclose the spring leaves 31.

The rotating barrel 4 is disposed within the sleeve 3, with its one end extending out of the sleeve 3 and having a suitable distance from the bowstring 14. A protection ferrule 41 is put over the protruded end of the rotating barrel 4. The rotating barrel 4 is formed with a plurality (say 4, in this embodiment) of longitudinally extending slots 42 around its outer surface, which are disposed so that when a slot 42 is turned to the shooting position of the rotating barrel 4, the slot 42 will be in a perpendicular position to the bowstring 14. Each slot 42 extends towards the center line of the barrel 4 to form a fletching slot 43 for receiving the fletching of an arrow. Around the rotating barrel 4 there are a sliding ring 44 and a positioning ring 45, the former having an annular groove 441 for receiving a screw 46 which extends through the sleeve 3 into the groove 441, the latter having a plurality of circular recesses 441 for accomodating the lower end of a resilient means 47.

Figure 3:
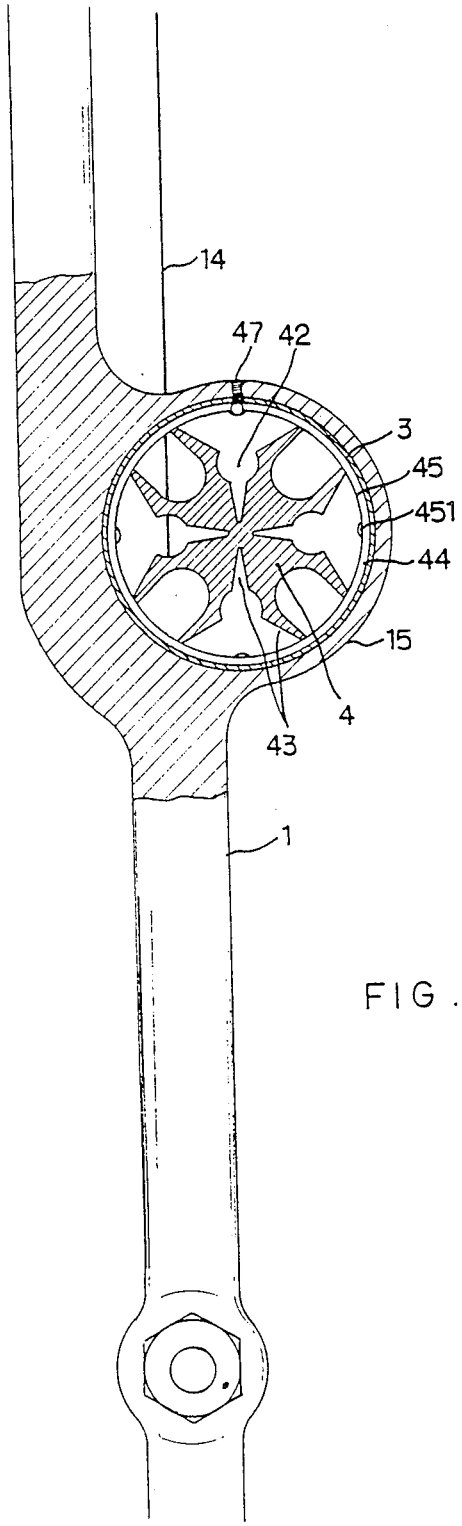
FIG. 3 is a sectional view taken along line A—A of FIG. 2.

Looking now at FIG. 3 is rigidly mounted in a fixed ring 15 of the bow 1, while, the rotating barrel 4 is disposed within the sleeve 3. The rotating barrel 4 is prevented from moving axially by the screw 46 and kept in position by the resilient means 47 when rotated through an appropriate angle.

In use, simply insert an arrow 2 into each slot 42 of the rotating barrel 4. Then, the arrows 2 would be pushed to predetermined positions and kept from sliding or rotating by the spring leaves 31. Thereafter, pull up the lift rod 32 and turn the lift rod 32 through an apropriate angle so that its lug 321 bears against the sleeve 3 thereby pulling outwards the spring leaf 31 pivoted at the lug 32 and therefore, no longer pressing the arrow 2. Lastly, engage the fletching 22 of the arrow 2 on the bowstring 14 and it is ready to pull the bowstring to shoot the arrow 2.

As the first arrow 2 is being shot, the arrow 2 is rapidly pushed out by the bowstring 4. Since the nock of the arrow 2 is engaged with the bowstring 14, the arrow 2 will not rotate when the bowstring 2 pushes the arrow 2 forwards thereby causing the fletching of the arrow 2 accurately passing through the fletching slot 43.

When desired to shoot another arrow 2, simply turn the protection shell 41 to rotate a slot 42 of the rotating barrel 4 loaded with an arrow 2 to the shooting position which is against the bowstring 14. Meanwhile, since one end of the spring leaf 31 raised by the lift rod 32 is fixed at the rotating barrel 3 and does not rotate with the rotating barrel 4, the arrow 2 to be shot will not be pressed and can be shot out without being interrupted.

Figure 4:
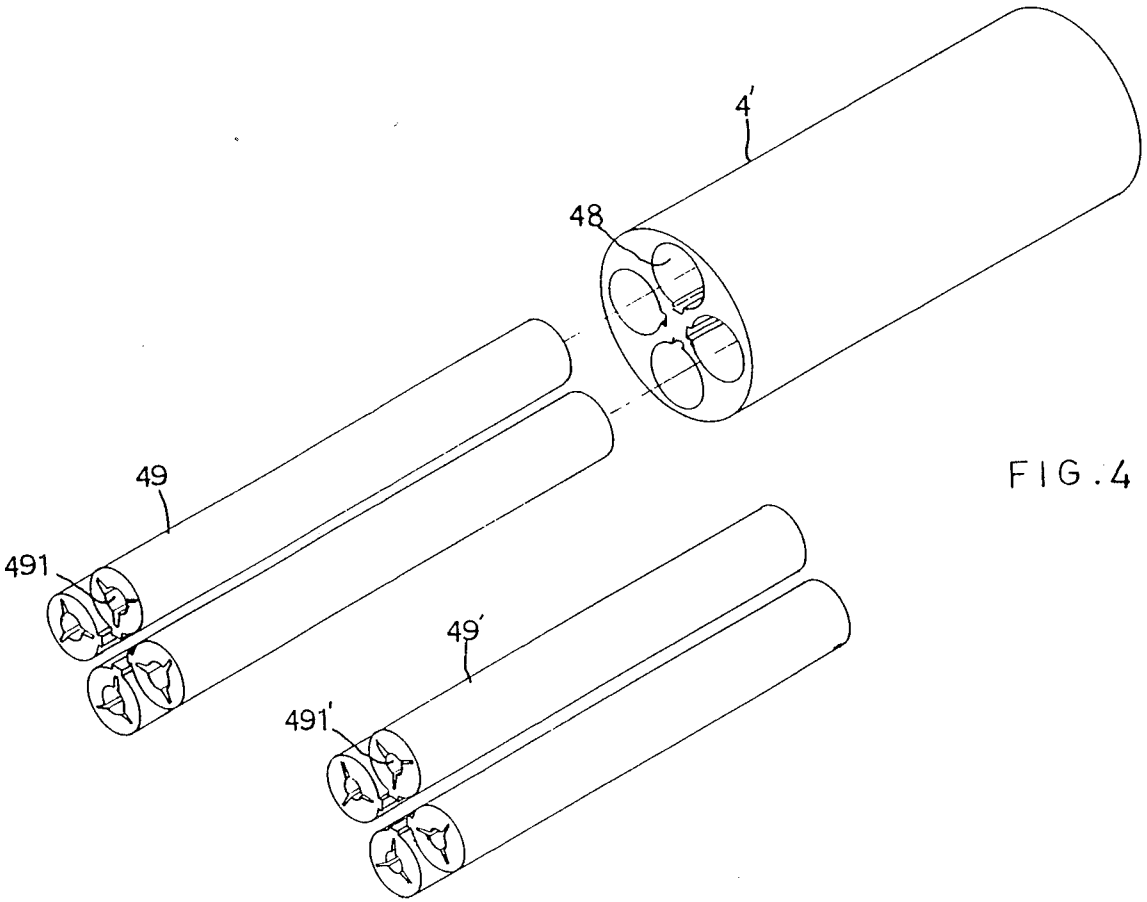
FIG. 4 is another preferred embodiment of present invention.
Figure 8:
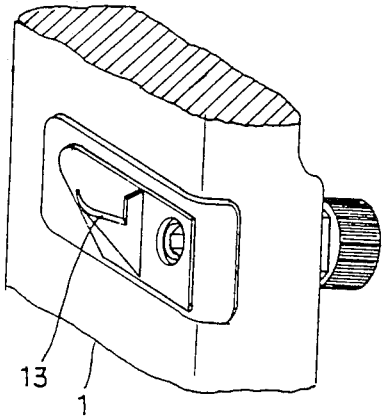
FIG.8 PRIOR ART
FIG. 8 is an enlarged fragmentary view of FIG. 7.
Figure 7:
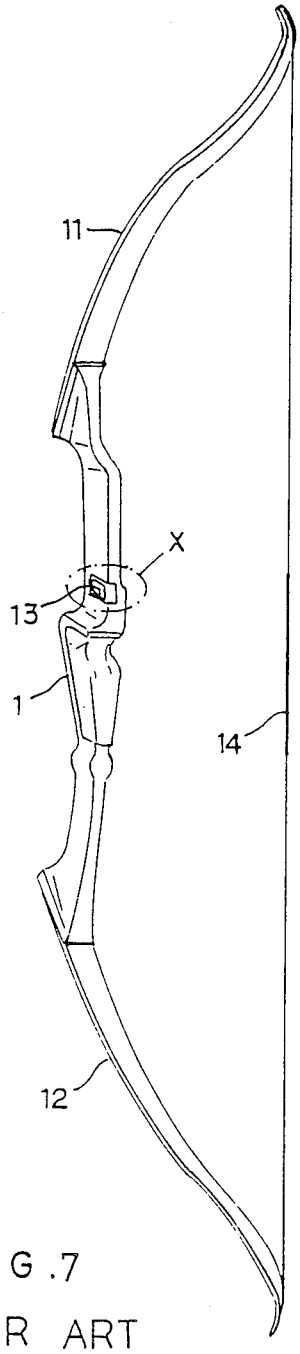
FIG.7 PRIOR ART
FIG. 7 is a prior art bow.

FIG. 4 shows another preferred embodiment of the present invention. As illustrated, the rotating barrel 4' has a plurality of slots 48 in each of which is inserted a cylindrical member 49' formed with a slot 491' for receiving an arrow so that the rotating barrel 4' can recover arrows of different sizes hence enabling the archer to shoot arrows consecutively.

Although the present invention has been described with a certain degree of particularity, it is understood the present disclosure is made by of example only and that numerous changes in the detailed construction and the combination and arrangement of parts may be resorted to without departing from the spirit and scope of the invention as hereinafter claimed.

I claim:

1. An arrow holder for a bow comprising:

a sleeve mounted within a retaining ring of the bow with one end thereof facing a bowstring of the bow, said sleeve having a front end provided with a plurality of spring leaves extending inwards one of which is pivotally connected with a lift rod connected to said sleeve;

a cover put over the front end of the sleeve;

a rotating barrel disposed within the sleeve with one end thereof extending out of a rear end of said sleeve being displaced by a predetermined distance from the bowstring, said rotating barrel having a plurality of longitudinally extending slots around the outer surface thereof for receiving arrows which are disposed so that when one of the slots is turned to a shooting position, the slot will be in a perpendicular position to the bowstring, each slot extending towards a center line of the rotating barrel to form a fletching slot for receiving a fletching of an arrow;

a sliding ring mounted on said rotating barrel, with an annular groove for receiving a screw extending strough the sleeve into the groove;

a positioning ring mounted on said rotating barrel, with a plurality of circular recesses for accomodating a lower end of a resilient means extending through the sleeve into the recess; and a protection ferrule mounted over a portion of said one end of said rotating barrel extending out of said rear end of said sleeve.

* * * * *